US011015587B2

(12) United States Patent
Nishii et al.

(10) Patent No.: US 11,015,587 B2
(45) Date of Patent: May 25, 2021

(54) PISTON COMPRESSOR

(71) Applicant: KABUSHIKI KAISHA TOYOTA JIDOSHOKKI, Aichi (JP)

(72) Inventors: Kei Nishii, Aichi-ken (JP); Shinya Yamamoto, Aichi-ken (JP); Akinobu Kanai, Aichi-ken (JP); Yoshinori Inoue, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 90 days.

(21) Appl. No.: 16/365,181

(22) Filed: Mar. 26, 2019

(65) Prior Publication Data

US 2019/0301440 A1 Oct. 3, 2019

(30) Foreign Application Priority Data

Mar. 30, 2018 (JP) ..... JP2018-068573
Mar. 22, 2019 (JP) ..... JP2019-054603

(51) Int. Cl.
*F04B 27/10* (2006.01)
*F04B 49/22* (2006.01)

(52) U.S. Cl.
CPC ..... *F04B 27/1018* (2013.01); *F04B 49/225* (2013.01)

(58) Field of Classification Search
CPC .... F04B 27/08; F04B 27/0808; F04B 27/086; F04B 27/10; F04B 27/1018; F04B 27/1063; F04B 27/14; F04B 27/16; F04B 27/18; F04B 27/1804; F04B 27/22; F04B 39/10; F04B 49/08; F04B 49/22; F04B 49/225

(Continued)

(56) References Cited

U.S. PATENT DOCUMENTS 5,362,208 A * 11/1994 Inagaki ..... F04B 27/1018 417/222.2
5,385,450 A 1/1995 Kimura et al.

(Continued)

FOREIGN PATENT DOCUMENTS

DE 4333144 4/1994
JP H05-306680 11/1993

(Continued)

*Primary Examiner* — Patrick Hamo
*Assistant Examiner* — Joseph S. Herrmann
(74) *Attorney, Agent, or Firm* — Greenblum & Bernstein, P.L.C.

(57) ABSTRACT

A piston compressor includes a housing, a drive shaft, a fixed swash plate, a plurality of pistons, a movable body, and a control valve. The housing includes a cylinder block having a plurality of cylinder bores and a plurality of first communication passages. The movable body has a second communication passage that intermittently communicates with each of the first communication passages by rotation of the drive shaft. A flow rate of refrigerant discharged from a compression chamber into a discharge chamber changes according to a position of the movable body in a direction of an axis of the drive shaft. The control valve is configured to control a control pressure. The first communication passages are connected to the second communication passage by the movable body and disconnected from the second communication passage by the drive shaft.

12 Claims, 7 Drawing Sheets

(58) Field of Classification Search
USPC ..... 417/212, 218, 269, 272, 273; 91/499, 91/504
See application file for complete search history.

(56) References Cited

U.S. PATENT DOCUMENTS

| | | | | | |
|---|---|---|---|---|---|
| 5,478,212 | A | * | 12/1995 | Sakai | F04B 27/1018 417/222.2 |
| 5,611,675 | A | * | 3/1997 | Uchida | F04B 27/1018 417/270 |
| 2003/0095873 | A1 | | 5/2003 | Tarutani et al. | |

FOREIGN PATENT DOCUMENTS

| | | |
|---|---|---|
| JP | H07-119631 | 5/1995 |
| JP | 2005-315176 | 10/2005 |

* cited by examiner

UPPER

LOWER

PISTON COMPRESSOR

CROSS-REFERENCE TO RELATED APPLICATION

This application claims priority to Japanese Patent Application No. 2018-068573 filed on Mar. 30, 2018 and Japanese Patent Application No. 2019-054603 filed on Mar. 22, 2019, the entire disclosure of which is incorporated herein by reference.

BACKGROUND ART

The present disclosure relates to a piston compressor.

Japanese Patent Application Publication No. H05-306680 mentions a known piston compressor (hereinafter simply referred to as a compressor). This compressor includes a housing, a drive shaft, a fixed swash plate, a plurality of pistons, a discharge valve, a control valve, and a movable body.

The housing includes a cylinder block. The cylinder block has a plurality of cylinder bores and a plurality of first communication passages in communication with the cylinder bores. The housing also has a discharge chamber, a swash plate chamber, a shaft hole, and a control pressure chamber. Refrigerant is introduced into the swash plate chamber from an outside of the compressor. The swash plate chamber is in communication with the shaft hole.

The drive shaft is rotatably supported in the shaft hole. The fixed swash plate is configured to rotate in the swash plate chamber by rotation of the drive shaft. The fixed swash plate has a constant inclination angle with respect to a plane that is perpendicular to the drive shaft. Each of the pistons forms a compression chamber in the corresponding cylinder bore, and each piston is coupled to the fixed swash plate. The reed-valve-type discharge valve is disposed between the compression chamber and the discharge chamber to discharge refrigerant in the compression chamber to the discharge chamber. The control valve controls a pressure of the refrigerant such that the pressure of the refrigerant becomes a control pressure.

The movable body is disposed on an outer peripheral surface of the drive shaft, and is disposed in the shaft hole. As a result, the movable body separates a suction chamber from the control pressure chamber. The movable body is movable integrally with the drive shaft in the shaft hole, and is movable relative to the drive shaft in a direction of the axis of the drive shaft according to the control pressure. A second communication passage is formed in an outer peripheral surface of the movable body.

In the compressor, the fixed swash plate is rotated by rotation of the drive shaft, so that each of the pistons reciprocates between a top dead center and a bottom dead center in the corresponding cylinder bore. The piston performs a suction stroke by moving from the top dead center to the bottom dead center, so that the corresponding compression chamber is put into a suction stroke. In this state, the corresponding first communication passage is connected to the second communication passage to introduce the refrigerant into the compression chamber. On the other hand, when the first communication is disconnected from the second communication passage and the corresponding piston moves from the bottom dead center to the top dead center, the compression chamber is put into a compression stroke in which the refrigerant has been introduced into the compression chamber is compressed and then into a discharge stroke in which the compressed refrigerant is discharged from the compression chamber into the discharge chamber. In this compressor, a communication angle, which is an angle around the axis of the drive shaft formed by the second communication passage and the first communication passage communicating with the second communication passage, per rotation of the drive shaft is changeable according to a position of the movable body in the direction of the axis of the drive shaft. This enables change of a flow rate of the refrigerant that is discharged from the compression chamber into the discharge chamber.

In this type of compressor, the movable body receives a load caused by refrigerant that is highly-compressed in the compression chamber (hereinafter referred to as a compressive load) and flows through the first communication passage in communication with the compression chamber in a compression stroke or in a discharge stroke. As a result, in the above known compressor, the movable body is pressed in a direction intersecting with the direction of the axis of the drive shaft in the shaft hole, so that the movable body is pressed against an inner wall of the shaft hole. This increases friction between the movable body moving in the direction of the axis of the drive shaft and the shaft hole and makes it difficult for the movable body to appropriately move in the direction of the axis, and thus, decreases controllability of the compressor.

To move the movable body in the direction of the axis with greater thrust, it is conceivable that a size of the movable body is increased. However, this needs to increase sizes of elements such as the shaft hole in response to the increased size of the movable body, thereby increasing a size of the compressor.

The present disclosure, which has been made in light of the above-described problem, is directed to providing a piston compressor that can be reduced in size while exhibiting high controllability.

SUMMARY

In accordance with an aspect of the present invention, there is provided a piston compressor including a housing, a drive shaft, a fixed swash plate, a plurality of pistons, a discharge valve, a movable body, and a control valve. The housing includes a cylinder block, a discharge chamber, a swash plate chamber, and a shaft hole. The cylinder block has a plurality of cylinder bores and a plurality of first communication passages in communication with the plurality of cylinder bores. The drive shaft is rotatably supported in the shaft hole. The fixed swash plate is configured to rotate in the swash plate chamber by rotation of the drive shaft and has a constant inclination angle with respect to a plane that is perpendicular to the drive shaft. Each of the pistons is accommodated in the corresponding cylinder bore. The piston forms a compression chamber in the cylinder bore and is coupled to the fixed swash plate. The discharge valve is configured to discharge refrigerant from the compression chamber into the discharge chamber. The movable body is disposed in the drive shaft and rotatable together with the drive shaft. The movable body is movable with respect to the drive shaft in a direction of an axis of the drive shaft according to the control pressure. The movable body has a second communication passage that intermittently communicates with each of the first communication passages by the rotation of the drive shaft. A flow rate of the refrigerant discharged from the compression chamber into the discharge chamber changes according to a position of the movable body in the direction of the axis of the drive shaft. The control valve is configured to control a control pressure.

The first communication passages are connected to the second communication passage by the movable body. The first communication passages are disconnected from the second communication passage by the drive shaft.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure together with objects and advantages thereof, may best be understood by reference to the following description of the embodiment together with the accompanying drawings in which.

DETAILED DESCRIPTION OF THE EMBODIMENTS

Figure 1:
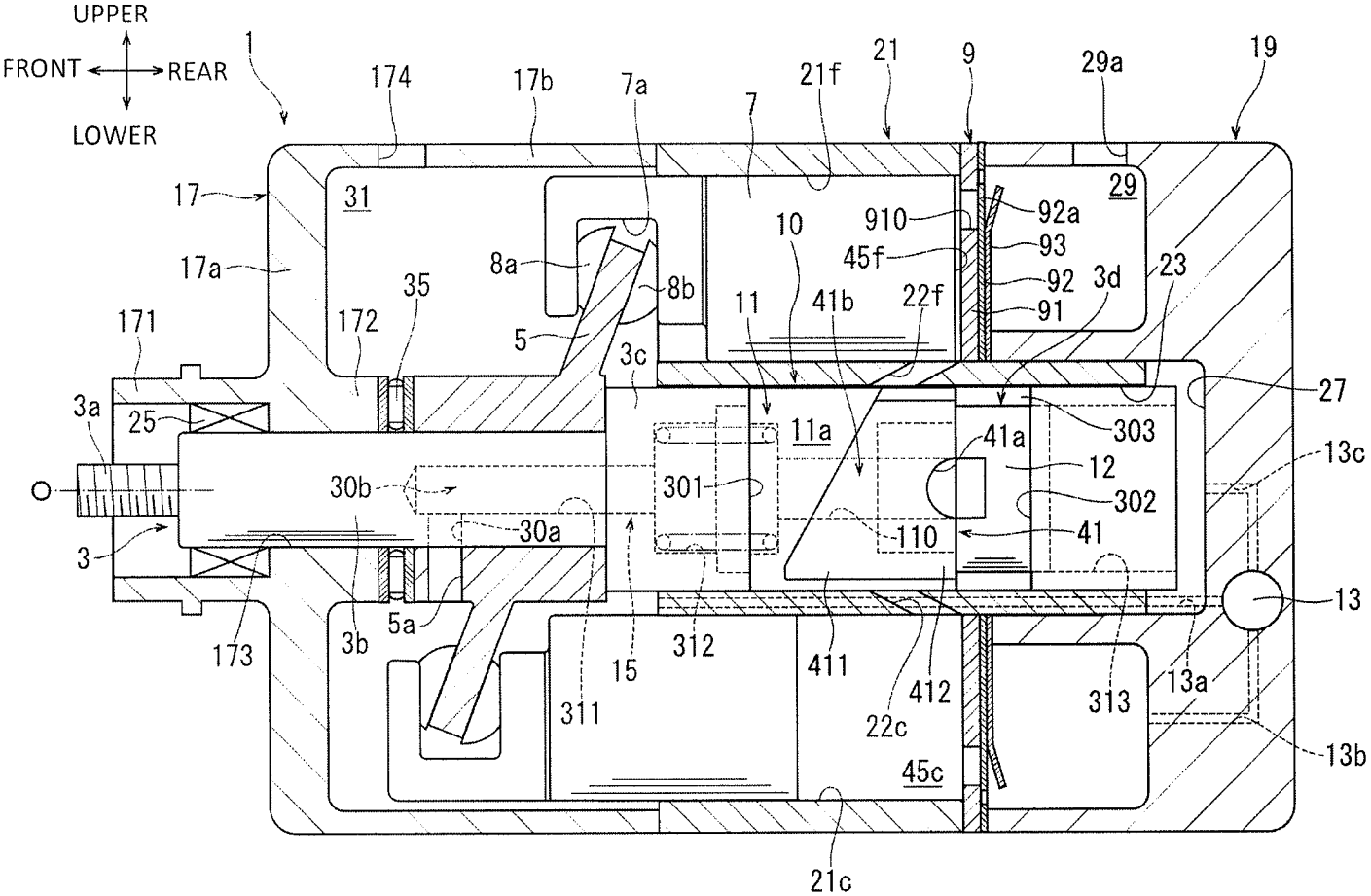
FIG. 1 is a cross-sectional view of a piston compressor according to an embodiment in a state that a discharge flow rate of refrigerant is maximal.

Hereinafter, an embodiment of the present disclosure will be described referring to the drawings. A compressor according to the embodiment is a single-head piston compressor. The compressor is mounted to a vehicle and is included in a refrigerant circuit of an air conditioning device.

Figure 2:
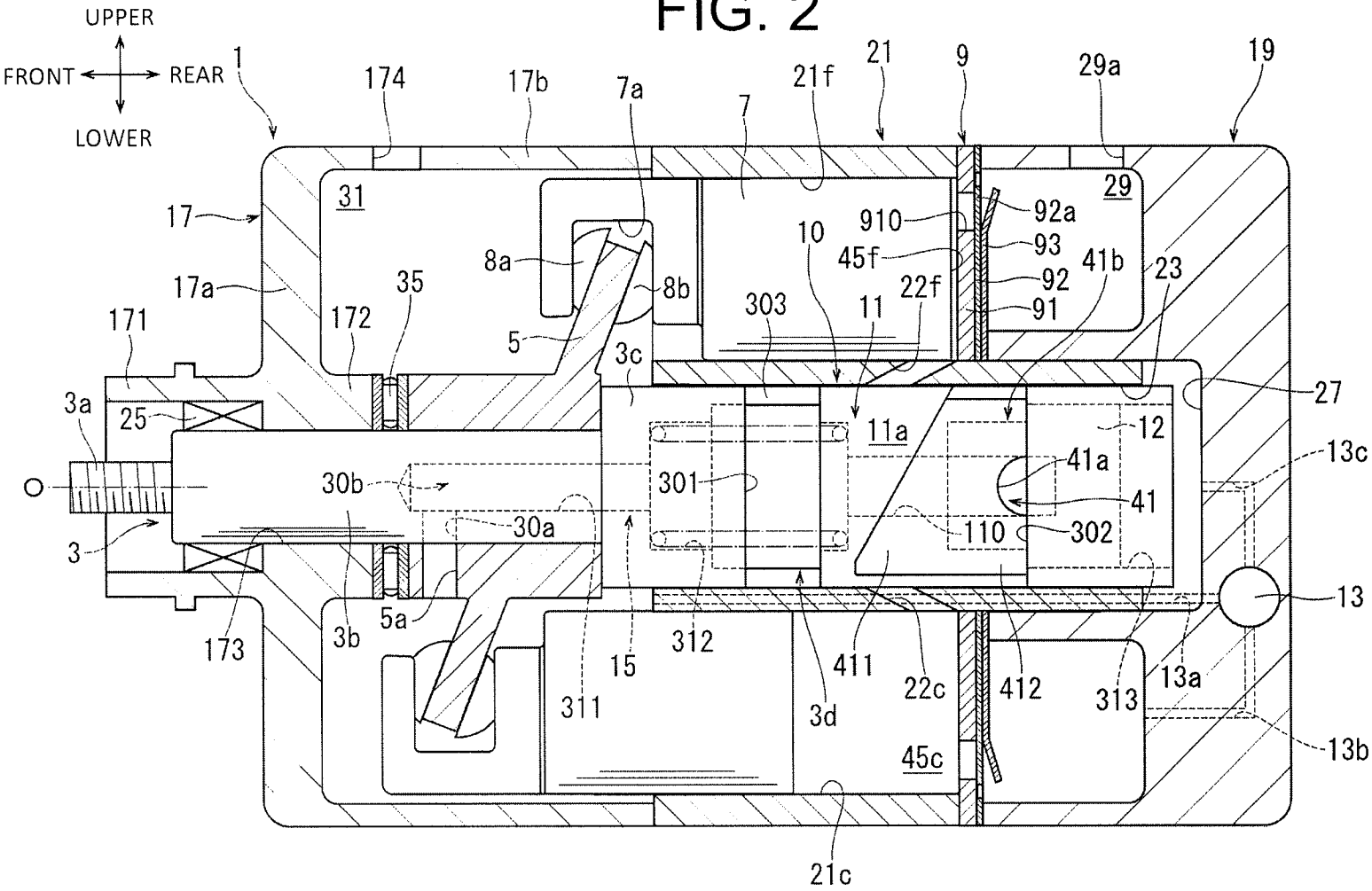
FIG. 2 is a cross-sectional view of the piston compressor according to the embodiment in a state that the discharge flow rate of the refrigerant is minimal.

As illustrated in FIGS. 1 and 2, the compressor according to the embodiment includes a housing 1, a drive shaft 3, a fixed swash plate 5, a plurality of pistons 7, a valve forming plate 9, a movable body 10, a control valve 13, and a suction mechanism 15. The valve forming plate 9 is an example of a "discharge valve" of the present disclosure.

The housing 1 includes a front housing 17, a rear housing 19, and a cylinder block 21. In the present embodiment, a front-to-rear direction of the compressor is defined in such a manner that a front side of the compressor is a side on which the front housing 17 is disposed and a rear side of the compressor is a side on which the rear housing 19 is disposed. Further, an up-to-down direction of the compressor is defined in such a manner that upper sides of FIGS. 1 and 2 are upper sides of the compressor, and lower sides of FIGS. 1 and 2 are lower sides of the compressor. FIGS. 3 to 8 indicate front-to-rear directions and up-to-down directions that correspond to those of FIGS. 1 and 2. The directions mentioned in the embodiment are merely examples, and the compressor of the present invention may be mounted appropriately in various postures depending on the vehicle on which the compressor is mounted.

The front housing 17 includes a front wall 17*a* that extends in a radial direction of the drive shaft 3 and a peripheral wall 17*b* that is integral with the front wall 17*a* and extends rearward from the front wall 17*a* in a direction of an axis O of the drive shaft 3. The peripheral wall 17*b* has an approximate cylindrical shape. The front wall 17*a* has a first boss 171, a second boss 172, and a first shaft hole 173. The first boss 171 projects forward in the direction of the axis O of the drive shaft 3. A shaft sealing device 25 is disposed in the first boss 171. The second boss 172 projects rearward in the direction of the axis O in a swash plate chamber 31, which will be described later. The first shaft hole 173 is formed through the front wall 17*a* in the direction of the axis O. The peripheral wall 17*b* has an inlet 174. The inlet 174 is connected to an evaporator through piping.

The rear housing 19 has a control pressure chamber 27, a discharge chamber 29, and an outlet 29*a*. The control pressure chamber 27 is formed at an approximate center of the rear housing 19. The discharge chamber 29 is formed in an annular shape, and is located outward of the control pressure chamber 27 in a radial direction of the discharge chamber 29. The outlet 29*a* is in communication with the discharge chamber 29, and extends in a radial direction of the rear housing 19 to open to an outside of the rear housing 19. The outlet 29*a* is connected to a condenser through piping. The piping, the evaporator, and the condenser are not illustrated in the drawings.

Figure 7:
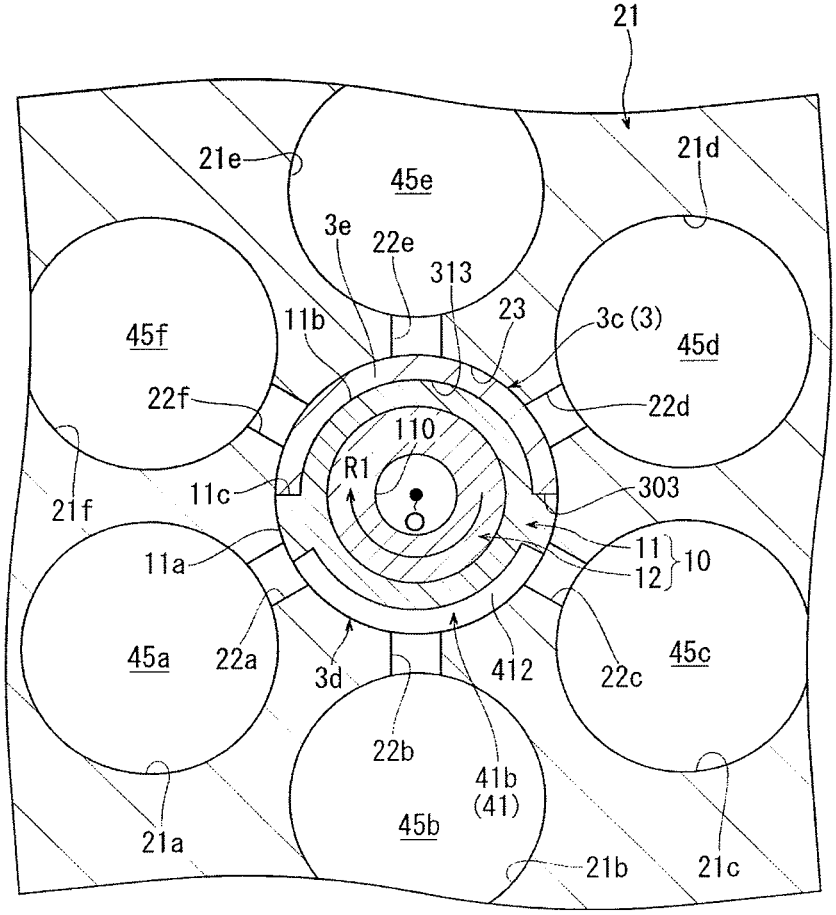
FIG. 7 is an enlarged cross-sectional view of the main part of the piston compressor according to the embodiment, taken along line B-B in FIG. 5.
Figure 8:
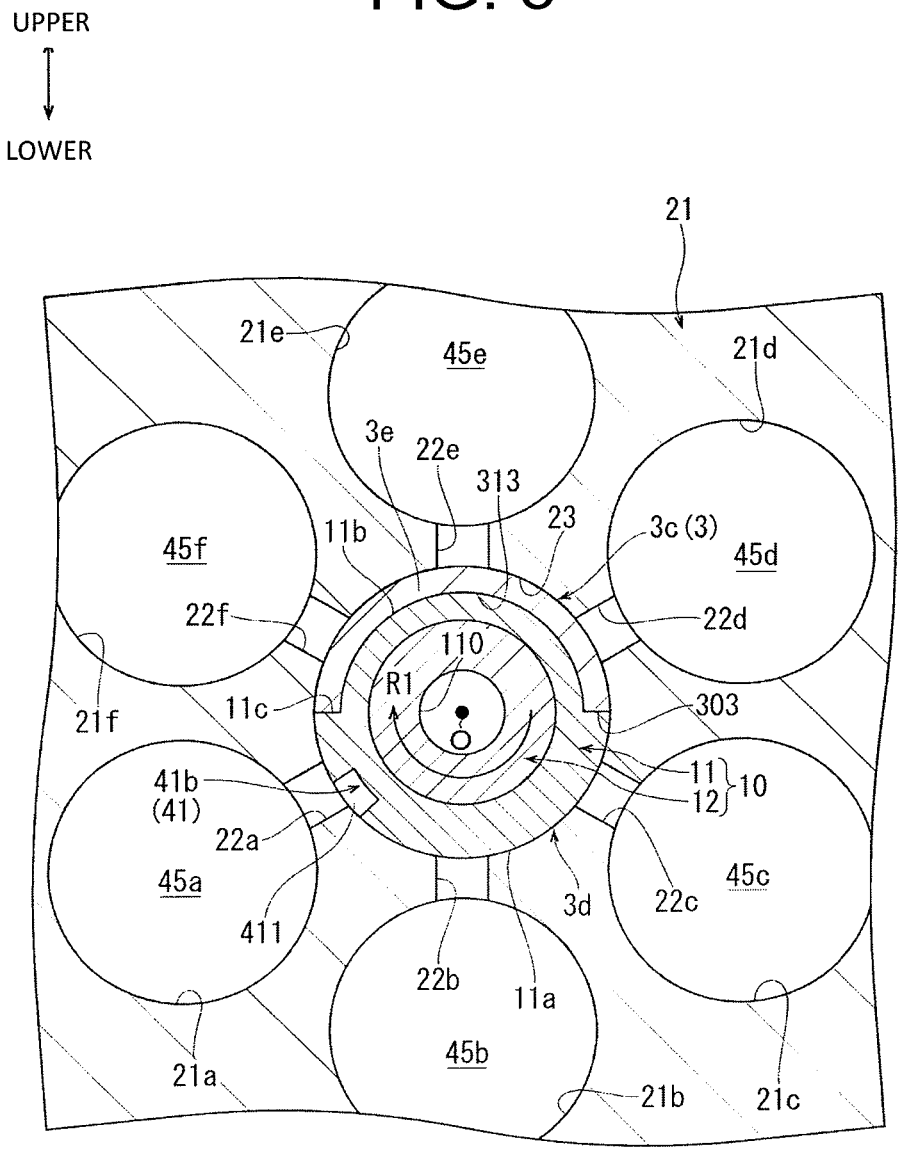
FIG. 8 is an enlarged cross-sectional view of the main part of the piston compressor according to the embodiment, taken along line C-C in FIG. 6.

The cylinder block 21 is disposed between the front housing 17 and the rear housing 19. As illustrated in FIGS. 7 and 8, the cylinder block 21 has a plurality of cylinder bores 21*a* to 21*f*. The cylinder bores 21*a* to 21*f* are arranged equiangularly in a circumferential direction of the cylinder block 21. As illustrated in FIGS. 1 and 2, the cylinder bores 21*a* to 21*f* extend in the direction of the axis O. The number of cylinder bores 21*a* to 21*f* is appropriately determined. The pistons 7 form a plurality of compression chambers 45*a* to 45*f* in the cylinder bores 21*a* to 21*f*, more specifically, the pistons 7 form the compression chambers 45*a* to 45*f* in the cylinder bore 21*a* to 21*f*, respectively.

The cylinder block 21 is joined to the front housing 17, so that the swash plate chamber 31 is formed between the front wall 17*a* and the peripheral wall 17*b* of the front housing 17. The swash plate chamber 31 is in communication with the inlet 174. Accordingly, refrigerant gas having a low pressure is introduced into the swash plate chamber 31 from the evaporator through the inlet 174.

Figure 5:
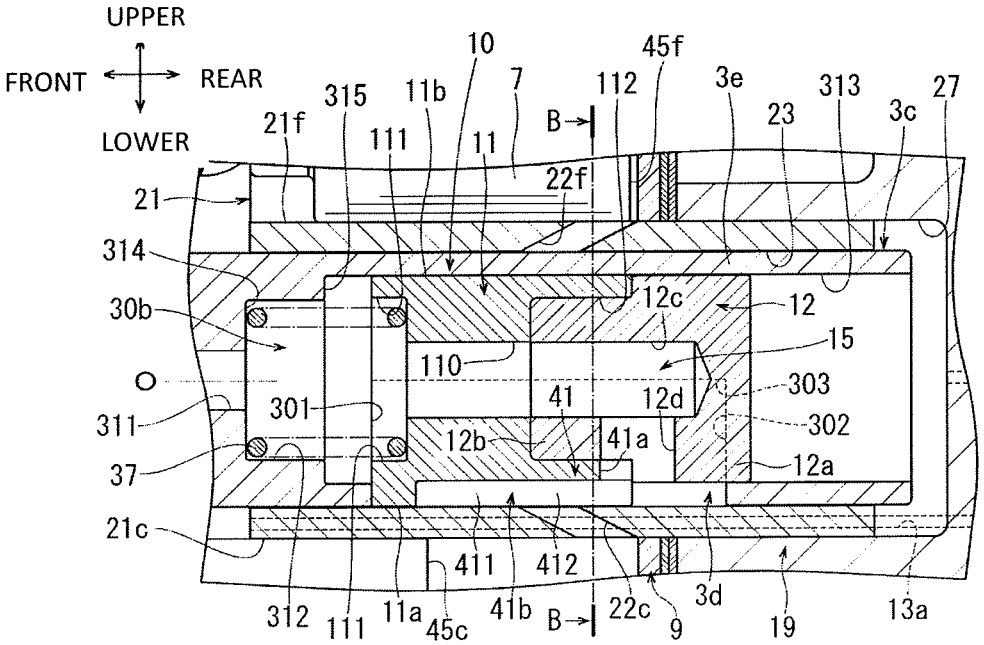
FIG. 5 is an enlarged cross-sectional view of a main part of the piston compressor according to the embodiment, illustrating elements such as the drive shaft and a movable body in a state that the discharge flow rate of the refrigerant is maximal.
Figure 6:
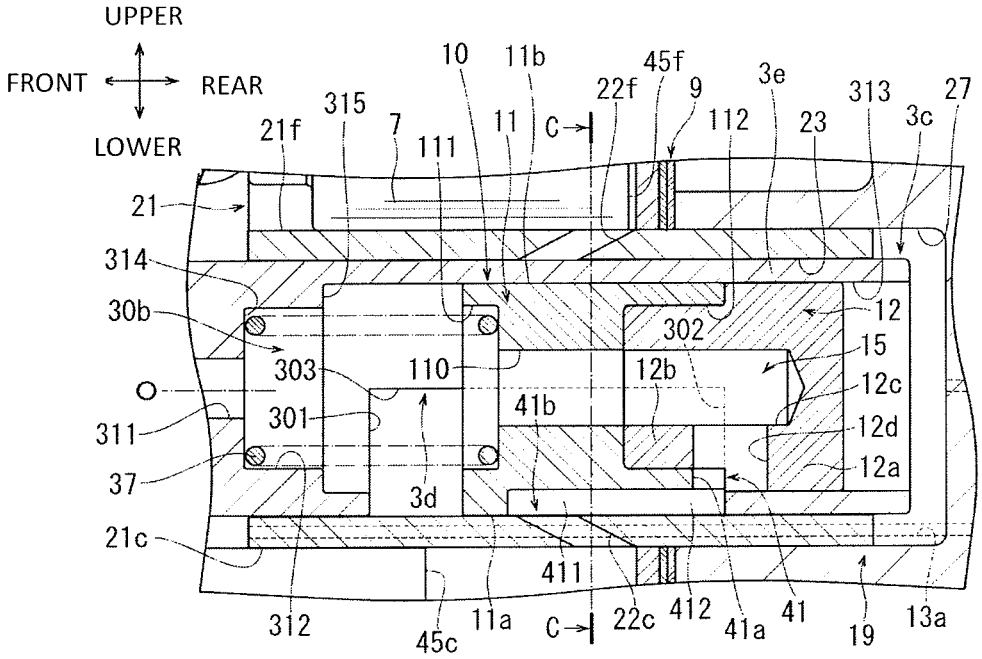
FIG. 6 is an enlarged cross-sectional view of the main part of the piston compressor according to the embodiment, illustrating the elements such as the drive shaft and the movable body in a state that the discharge flow rate of the refrigerant is minimal.

As illustrated in FIGS. 5 and 6, the cylinder block 21 of the housing 1 has a second shaft hole 23. The first shaft hole 173 and the second shaft hole 23 are examples of a "shaft hole" of the present disclosure. The second shaft hole 23 is formed through the cylinder block 21 in the direction of the axis O at an approximate center of the cylinder block 21. The cylinder block 21 is joined to the rear housing 19 through the valve forming plate 9, so that the rear part of the second shaft hole 23 is located in the control pressure chamber 27.

Accordingly, the second shaft hole 23 is in communication with the control pressure chamber 27.

As illustrated in FIGS. 7 and 8, the cylinder block 21 further has a plurality of first communication passages 22*a* to 22*f*. The first communication passages 22*a* to 22*f* are in communication with the cylinder bores 21*a* to 21*f* at one ends of the first communication passages 22*a* to 22*f*, respectively. The first communication passages 22*a* to 22*f* extend in a radial direction of the cylinder block 21. Accordingly, the first communication passages 22*a* to 22*f* are in communication with the second shaft hole 23 at the other ends of the first communication passages 22*a* to 22*f*.

The valve forming plate 9 is disposed between the rear housing 19 and the cylinder block 21. The rear housing 19 is joined to the cylinder block 21 through the valve forming plate 9.

The valve forming plate 9 includes a valve plate 91, a discharge-valve plate 92, and a retainer plate 93. The valve plate 91 has a plurality of discharge holes, which, in this embodiment, six discharge holes 910. The discharge holes 910 are in communication with the cylinder bores 21*a* to 21*f*, respectively. Each of the cylinder bores 21*a* to 21*f* communicates with the discharge chamber 29 through the corresponding discharge hole 910.

The discharge-valve plate 92 is disposed on a rear surface of the valve plate 91. The discharge-valve plate 92 includes a plurality of discharge reed valves 92*a*, specifically, six discharge reed valves 92*a*. Each of the six discharge reed valves 92*a* elastically deforms to open and close the corresponding discharge hole 910. The retainer plate 93 is disposed on a rear surface of the discharge-valve plate 92. The retainer plate 93 defines a maximum opening degree of the discharge reed valves 92*a*.

The drive shaft 3 is made of steel, and has rigidity against a compressive load of highly compressed refrigerant gas. The drive shaft 3 extends from the front side of the housing 1 to the rear side of the housing 1 in the direction of the axis O. The drive shaft 3 has a threaded portion 3*a*, a first-diameter portion 3*b*, and a second-diameter portion 3*c*. The threaded portion 3*a* is disposed at a front end of the drive shaft 3. The drive shaft 3 is coupled to components such as a pulley or an electromagnetic clutch, which are not illustrated in the drawings, by the threaded portion 3*a*. The first-diameter portion 3*b* continues to a rear end of the threaded portion 3*a*, and extends in the direction of the axis O.

Figure 3:
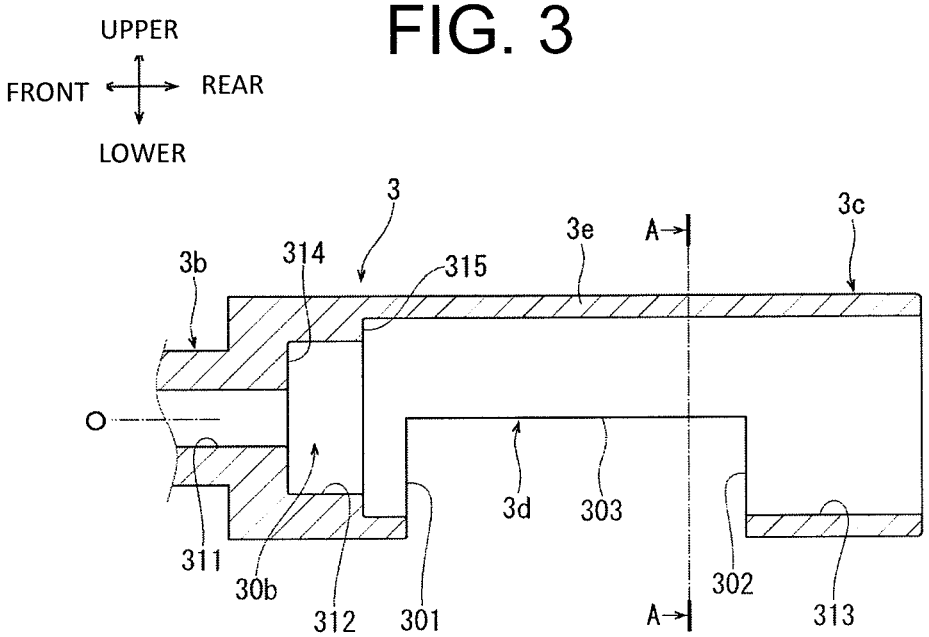
FIG. 3 is an enlarged cross-sectional view of a main part of the piston compressor according to the embodiment, illustrating a drive shaft.
Figure 4:
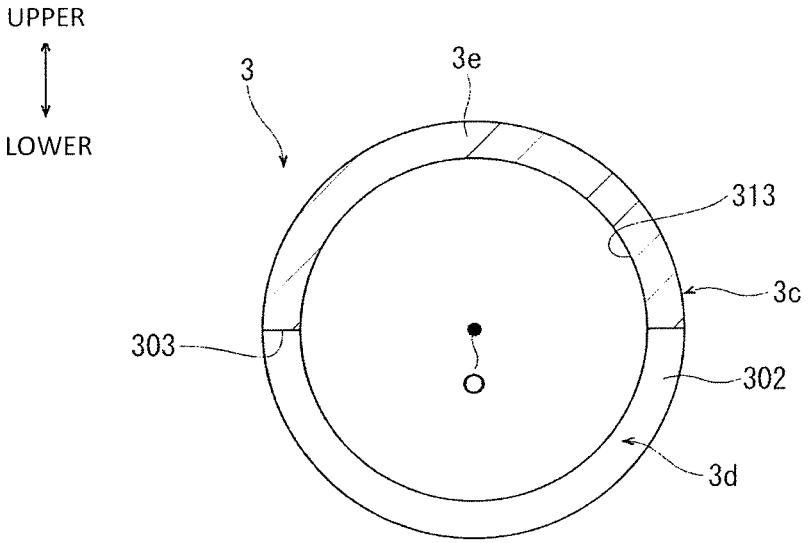
FIG. 4 is an enlarged cross-sectional view of a main part of the piston compressor according to the embodiment, taken along line A-A in FIG. 3.

The second-diameter portion 3*c* continues to a rear end of the first-diameter portion 3*b*, and extends in the direction of the axis O. The second-diameter portion 3*c* is formed into a cylindrical shape that has substantially the same diameter as a diameter of the second shaft hole 23, and has a larger diameter than a diameter of the first-diameter portion 3*b*. As illustrated in FIGS. 3 and 4, the second-diameter portion 3*c* of the drive shaft 3 has a guiding window 3*d*. The guiding window 3*d* is formed over a half circumference of the second-diameter portion 3*c*, and extends in the direction of the axis O. As illustrated in FIGS. 7 and 8, the guiding window 3*d* is formed in the second-diameter portion 3*c* such that the guiding window 3*d* faces some of the first communication passages 22*a* to 22*f* that are in communication with corresponding ones of the compression chambers 45*a* to 45*f* that are in a suction stroke. A part of the second-diameter portion 3*c* located opposite to the guiding window 3*d* with respect to the axis O is a main body 3*e*. That is, the drive shaft 3 includes the main body 3*e*, and the main body 3*e* is formed in the second-diameter portion 3*c* such that the main body 3*e* faces some of the first communication passages 22*a* to 22*f* in communication with corresponding ones of the compression chambers 45*a* to 45*f* that are in a compression stroke or a discharge stroke. As illustrated in FIG. 4, the main body 3*e* is formed into a semi-circular tub-like shape and located opposite to the guiding window 3*d* with respect to the axis O, and extends in the direction of the axis O.

As illustrated in FIG. 3, a part of the second-diameter portion 3*c* oriented rearward to face the guiding window 3*d* is a first limiting surface 301, and a part of the second-diameter portion 3*c* oriented frontward to face the guiding window 3*d* is a second limiting surface 302. A part of the second-diameter portion 3*c* extending in the direction of the axis O between the first limiting surface 301 and the second limiting surface 302 and facing the guiding window 3*d*, i.e. an end surface of the main body 3*e*, is a guiding surface 303.

As illustrated in FIGS. 1 and 2, the drive shaft 3 has a first radial passage 30*a* and an axial passage 30*b*. The first radial passage 30*a* is formed in the first-diameter portion 3*b*, and extends in a radial direction of the first-diameter portion 3*b* to open on an outer peripheral surface of the first-diameter portion 3*b*. The axial passage 30*b* has a first axial passage 311, a second axial passage 312, and a third axial passage 313. The first axial passage 311 is formed extending from inside the first-diameter portion 3*b* to an inside of the second-diameter portion 3*c*. The first axial passage 311 extends in the direction of the axis O, and is in communication with the first radial passage 30*a* at a front end part of the first axial passage 311.

As illustrated in FIG. 3, the second axial passage 312 is formed in the second-diameter portion 3*c*. The second axial passage 312 extends in the direction of the axis O, and is in communication with the first axial passage 311 at a front end of the second axial passage 312. The second axial passage 312 has a larger diameter than the first axial passage 311. Accordingly, a first step 314 is formed between the first axial passage 311 and the second axial passage 312. The third axial passage 313 is formed in the second-diameter portion 3*c*. The third axial passage 313 extends in the direction of the axis O such that a front end of the third axial passage 313 is in communication with the second axial passage 312 and a rear end of the third axial passage 313 is open at a rear end of the second-diameter portion 3*c*, i.e. a rear end of the drive shaft 3. Further, the third axial passage 313 is in communication with the guiding window 3*d*. Accordingly, the third axial passage 313 is in communication with an outside of the second-diameter portion 3*c* through the guiding window 3*d*. The third axial passage 313 has a larger diameter than the second axial passage 312. Accordingly, a second step 315 is formed between the second axial passage 312 and the third axial passage 313.

As illustrated in FIGS. 1 and 2, the first-diameter portion 3*b* is supported by the first shaft hole 173 and the second-diameter portion 3*c* is supported by the second shaft hole 23, so that the drive shaft 3 is rotatably supported in the first and second shaft holes 173, 23 and disposed in the housing 1. More specifically, in the present embodiment, the drive shaft 3 is configured to rotate in a direction R1 illustrated in FIGS. 7 and 8.

As illustrated in FIGS. 5 and 6, the second-diameter portion 3*c* extends out of the second shaft hole 23 at a rear end of the second-diameter portion 3*c* and into the control pressure chamber 27. Accordingly, the axial passage 30*b* is in communication with the control pressure chamber 27 at a rear end of the axial passage 30*b*.

As illustrated in FIGS. 1 and 2, the drive shaft 3 is inserted into the shaft sealing device 25 disposed in the first boss 171. The shaft sealing device 25 seals the housing 1.

The fixed swash plate 5 is press-fitted onto the first-diameter portion 3*b* of the drive shaft 3, and is disposed in the swash plate chamber 31. Accordingly, the fixed swash plate 5 is configured to rotate together with the drive shaft 3 in the swash plate chamber 31 by rotation of the drive shaft 3. The fixed swash plate 5 has a constant inclination angle with respect to a plane that is perpendicular to the drive shaft 3. In addition, a thrust bearing 35 is disposed between the second boss 172 and the fixed swash plate 5 in the swash plate chamber 31.

The fixed swash plate 5 has a drawing passage 5*a* that extends in the radial direction of the drive shaft 3 and opens to the swash plate chamber 31. The drawing passage 5*a* is in communication with the first radial passage 30*a*. Accordingly, the axial passage 30*b* is in communication with the swash plate chamber 31 through the drawing passage 5*a* and the first radial passage 30*a*.

The pistons 7 are respectively accommodated in the cylinder bores 21*a* to 21*f*. As illustrated in FIGS. 7 and 8, the pistons 7 cooperate with the valve forming plate 9 to form the compression chambers 45*a* to 45*f* in the cylinder bores 21*a* to 21*f*, respectively. The pistons 7 are not illustrated in FIGS. 7 and 8 to facilitate the description.

As illustrated in FIGS. 1 and 2, each of the pistons 7 has an engagement portion 7*a*. The engagement portion 7*a* accommodates shoes 8*a*, 8*b* each having a semi-spherical shape. The piston 7 is coupled to the fixed swash plate 5 by the shoes 8*a*, 8*b*. The shoes 8*a*, 8*b* function as a conversion mechanism for converting rotation of the fixed swash plate 5 into reciprocating motion of the piston 7. The piston 7 is configured to reciprocate between a top dead center of the piston 7 and a bottom dead center of the piston 7 in a corresponding one of the cylinder bores 21*a* to 21*f*. Hereinafter, the top dead center and the bottom dead center of each of the pistons 7 will be referred to as a top dead center and a bottom dead center.

As illustrated in FIGS. 5 and 6, the movable body 10 includes a first movable body 11 and a second movable body 12. The first movable body 11 is disposed in the guiding window 3*d* of the second-diameter portion 3*c* of the drive shaft 3. The first movable body 11 is rotatable together with the drive shaft 3 in the second shaft hole 23. The first movable body 11 has a first connection passage 110 that extends in the direction of the axis O. The first movable body 11 has a cylindrical shape and extends in the direction of the axis O. More specifically, as illustrated in FIGS. 7 and 8, the first movable body 11 has a forming surface 11*a*, a sliding surface 11*b*, and a guided surface 11*c*. The forming surface 11*a* has a semicircular shape that has the same diameter as the second-diameter portion 3*c*. The sliding surface 11*b* is located opposite to the forming surface 11*a* with respect to the axis O, and is formed into a semicircular shape that has the same diameter as the third axial passage 313. The guided surface 11*c* is formed between the forming surface 11*a* and the sliding surface 11*b*.

The first movable body 11 is disposed in the guiding window 3*d*, so that the forming surface 11*a* of the first movable body 11 is located opposite to the main body 3*e* with respect to the axis O, and is exposed in the second shaft hole 23. In other words, the guiding window 3*d* exposes the movable body 10 to the second shaft hole 23 while guiding the movable body 10. The forming surface 11*a* has a semicircular shape that has the same diameter as the second-diameter portion 3*c*, so that the forming surface 11*a* forms a cylindrical body, whose diameter is substantially the same as the diameter of the second shaft hole 23, by cooperating with the main body 3*e*. The second-diameter portion 3*c* is disposed in the second shaft hole 23, and the forming surface 11*a* with the main body 3*e* fits to the second shaft hole 23.

Further, the first movable body 11 is disposed in the guiding window 3*d*, so that the sliding surface 11*b* is disposed in the third axial passage 313. The guided surface 11*c* is located in contact with the guiding surface 303. Accordingly, the second-diameter portion 3*c* supports the first movable body 11 through the third axial passage 313 and the guiding surface 303. The first movable body 11 is disposed in the guiding window 3*d*, so that a front surface of the first movable body 11, i.e. a front surface of the movable body 10, receives a suction pressure through the first and second axial passages 311, 312 in the axial passage 30*b*, as illustrated in FIGS. 5 and 6. The suction pressure will be described later.

The first movable body 11 has a first accommodation recess 111 and a second accommodation recess 112. The first accommodation recess 111 is recessed in a front surface of the first movable body 11. The second accommodation recess 112 is recessed in a rear surface of the first movable body 11. The first accommodation recess 111 and the second accommodation recess 112 are each in communication with the first connection passage 110.

A length of the first movable body 11 in the direction of the axis O is shorter than a length of the guiding window 3*d* in the direction of the axis O. Accordingly, the sliding surface 11*b* slides in the third axial passage 313 with the guided surface 11*c* guided by the guiding surface 303, so that the first movable body 11 is disposed in the guiding window 3*d* and is movable in the direction of the axis O in the second shaft hole 23. That is, the first movable body 11 is movable with respect to the drive shaft 3 in the direction of the axis O of the drive shaft 3 according to the control pressure. As illustrated in FIG. 5, when the first movable body 11 moves most forward in the direction of the axis O in the guiding window 3*d*, the first movable body 11 comes into contact with the first limiting surface 301. This limits the forward movement of the first movable body 11. As illustrated in FIG. 6, when the first movable body 11 moves most rearward in the direction of the axis O in the guiding window 3*d*, the first movable body 11 comes into contact with the second limiting surface 302. This limits the rearward movement of the first movable body 11.

In the axial passage 30*b*, a coil spring 37 is disposed between the first step 314 and the first accommodation recess 111. The coil spring 37 urges the first movable body 11, that is, the movable body 10, toward the back of the guiding window 3*d*.

The first movable body 11 further has a second communication passage 41 that is recessed in the forming surface 11*a*. The second communication passage 41 includes a second radial passage 41*a* and a main-body passage 41*b*. The second radial passage 41*a* extends in a radial direction of the forming surface 11*a*, and is in communication with the second accommodation recess 112.

The main-body passage 41*b* of the second communication passage 41 is recessed in the forming surface 11*a*, and is in communication with the second radial passage 41*a*. More specifically, as illustrated in FIGS. 1 and 2, the main-body passage 41*b* is formed in the forming surface 11*a* and extends from an approximate center of the first movable body 11 to a rear end of the first movable body 11 in a front-to-rear direction of the first movable body 11. The main-body passage 41*b* gradually expands in a circumferential direction of the forming surface 11*a* from a front end to a rear end of the main-body passage 41*b* with extension of the main-body passage 41*b*. The main-body passage 41*b* has a first region 411 on its front end side and a second region 412 on its rear end side. That is, the first region 411 is narrower than the second region 412 in the circumferential direction of the forming surface 11*a*, so that the second region 412 is wider than the first region 411 in the circumferential direction of the forming surface 11*a*. A shape of the main-body passage 41*b* is determined appropriately. In FIGS. 5 to 8, a shape of the main-body passage 41*b* is simplified to facilitate the description.

As illustrated in FIGS. 7 and 8, the first movable body 11 rotates in the direction R1 in the guiding window 3*d* by the rotation of the drive shaft 3 in the direction R1, so that the main-body passage 41*b* of the second communication passage 41 intermittently communicates with each of the first communication passages 22*a* to 22*f*. In other words, each of the first communication passages 22*a* to 22*f* is intermittently connected to the main-body passage 41*b* of the second communication passage 41 by the first movable body 11. A communication angle around the axis O, which is formed by the main-body passage 41*b* of the second communication passage 41 and some of the first communication passages 22*a* to 22*f* communicating with the main-body passage 41*b* per rotation of the drive shaft 3, changes according to a position of the first movable body 11 in the guiding window 3*d*. Hereinafter, this communication angle will be simply referred to as a communication angle. In FIGS. 1 and 2, the movable body 10 including the movable body 11 is displaced from a position of the movable body 10 illustrated in FIGS. 5 to 8 with respect to the axis O, for explanation.

As illustrated in FIGS. 5 and 6, the second movable body 12 is disposed in the third axial passage 313. The second movable body 12 has a large-diameter portion 12*a*, a small-diameter portion 12*b*, a second connection passage 12*c*, and a third radial passage 12*d*. A diameter of the large-diameter portion 12*a* is substantially the same of a diameter of the third axial passage 313, and the large-diameter portion 12*a* forms a rear of the second movable body 12. The small-diameter portion 12*b* is integral with the large-diameter portion 12*a*, and extends forward from the large-diameter portion 12*a*. A diameter of the small-diameter portion 12*b* is smaller than a diameter of the large-diameter portion 12*a*, and the small-diameter portion 12*b* is press-fitted in the second accommodation recess 112. Accordingly, the second movable body 12 is disposed behind the first movable body 11 and fixed to the first movable body 11, so that the second movable body 12 is rotatable together with the first movable body 11. The first movable body 11 moves in the direction of the axis O in the guiding window 3*d*, so that the second movable body 12 moves in the direction of the axis O in the third axial passage 313. The large-diameter portion 12*a* may be splined to the second-diameter portion 3*c* in the third axial passage 313.

The second connection passage 12*c* extends in the second movable body 12 in the direction of the axis O, and is in communication with the first connection passage 110. The third radial passage 12*d* is in communication with the second connection passage 12*c*, and extends in the second movable body 12 in a radial direction of the second movable body 12 to open on outer peripheral surfaces of the large-diameter portion 12*a* and the small-diameter portion 12*b*. Accordingly, the third radial passage 12*d* is in communication with the second radial passage 41*a*.

The second movable body 12 is disposed in the third axial passage 313, so that a control pressure acts on a rear surface of the second movable body 12. Accordingly, the control pressure acts on a rear surface of the first movable body 11 via the second movable body 12. The control pressure will be described later.

As illustrated in FIGS. 1 and 2, the control valve 13 is disposed in the rear housing 19. The rear housing 19 cooperates with the cylinder block 21 to have a detection passage 13*a*. The rear housing 19 has a first supply passage 13*b* and a second supply passage 13*c*. The control valve 13 is connected to the swash plate chamber 31 through the detection passage 13*a*. The control valve 13 is also connected to the discharge chamber 29 through the first supply passage 13*b* and connected to the control pressure chamber 27 through the second supply passage 13*c*. The refrigerant gas in the discharge chamber 29 is partly introduced into the control pressure chamber 27 through the first supply passage 13*b*, the second supply passage 13*c*, and the control valve 13. The control pressure chamber 27 is connected to the swash plate chamber 31 through a bleed passage (not shown) to introduce the refrigerant gas in the control pressure chamber 27 into the swash plate chamber 31 though the bleed passage. The control valve 13 adjusts its opening degree by monitoring and detecting the suction pressure, which is the pressure of refrigerant gas in the swash plate chamber 31, with the detection passage 13*a*. Consequently, the control valve 13 controls the flow rate of the refrigerant gas introduced from the discharge chamber 29 into the control pressure chamber 27 through the first supply passage 13*b* and the second supply passage 13*c*. More specifically, the control valve 13 increases its valve opening degree to increase the flow rate of the refrigerant gas introduced from the discharge chamber 29 into the control pressure chamber 27 through the first supply passage 13*b* and the second supply passage 13*c*, and decreases its valve opening degree to decrease the flow rate of the refrigerant gas introduced from the discharge chamber 29 into the control pressure chamber 27 through the first supply passage 13*b* and the second supply passage 13*c*. The control valve 13 changes the flow rate of the refrigerant gas introduced from the discharge chamber 29 into the control pressure chamber 27 against the flow rate of the refrigerant gas introduced from the control pressure chamber 27 into the swash plate chamber 31 to control the control pressure, which is a pressure of refrigerant gas in the control pressure chamber 27.

The suction mechanism 15 includes the drawing passage 5*a*, the first radial passage 30*a*, the axial passage 30*b*, the first and second connection passages 110, 12*c*, the third radial passage 12*d*, and the second communication passage 41. The suction mechanism 15 introduces refrigerant gas from the swash plate chamber 31 into each of the compression chambers 45*a* to 45*f* through the second communication passage 41. More specifically, the refrigerant gas in the swash plate chamber 31 reaches the third radial passage 12*d* through the drawing passage 5*a*, the first radial passage 30*a*, the axial passage 30*b*, and the first and second connection passages 110, 12*c*. Then, the refrigerant gas, which has reached the third radial passage 12*d*, flows to the main-body passage 41*b* through the second radial passage 41*a*. That is, the suction mechanism 15 introduces the refrigerant gas into the compression chambers 45*a* to 45*f* from the main-body passage 41*b* through the corresponding first communication passages 22*a* to 22*f*.

In this compressor, as described above, the fixed swash plate 5 is rotated in the swash plate chamber 31 by rotation of the drive shaft 3. The pistons 7 repeatedly reciprocate in the cylinder bores 21*a* to 21*f* between their top dead centers and the bottom dead centers, so that the pistons 7 repeatedly perform a suction stroke for introducing refrigerant gas from the swash plate chamber 31, a compression stroke for compressing the introduced refrigerant gas, and a discharge stroke for discharging the compressed refrigerant gas in the compression chambers 45*a* to 45*f*, respectively. The valve forming plate 9 is configured to discharge the refrigerant gas from the compression chambers 45*a* to 45 in a discharge stroke into the discharge chamber 29. Then, the refrigerant gas in the discharge chamber 29 is discharged into the condenser through the outlet 29*a*.

Figure 9:
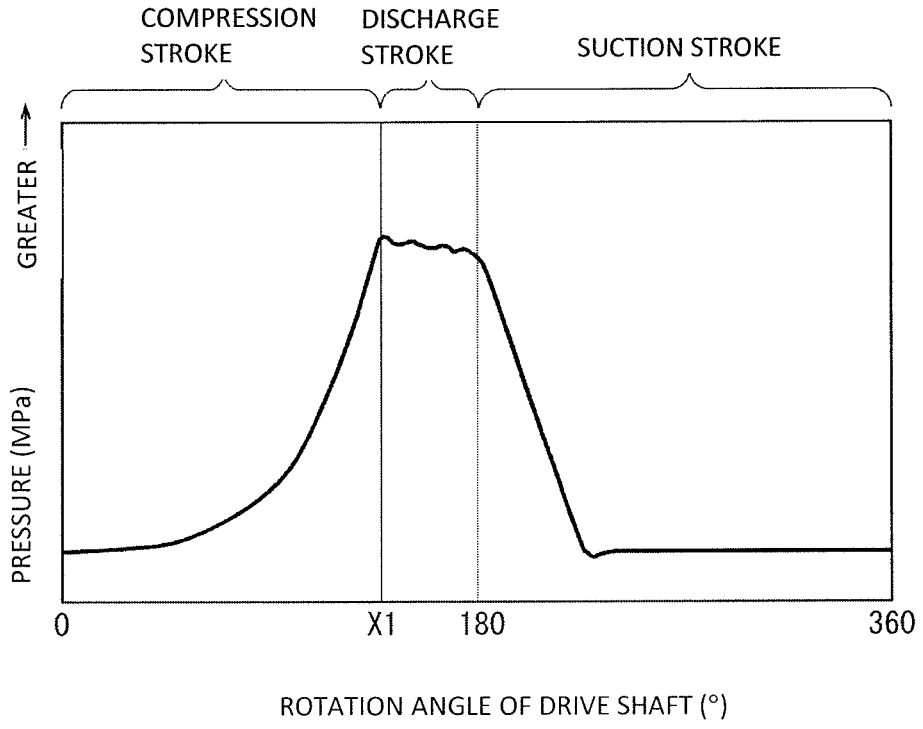
FIG. 9 is a graph that illustrates pressure change in a compression chamber in one rotation of the drive shaft of the piston compressor according to the embodiment.

As illustrated in FIG. 9, the compressor performs a compression stroke while the drive shaft 3 rotates from a position of 0° to a position of X1° (X1° is a rotation angle of the drive shaft 3 at which the pressure in each of the compression chambers 45*a* to 45*f* becomes highest). Then, the compressor performs a discharge stroke while the drive shaft 3 rotates from the position of X1° to a position of 180°, and performs a suction stroke while the drive shaft 3 rotates from the position of 180° to a position of 360°. That is, each of the pistons 7 moves from the bottom dead center to the top dead center while the drive shaft 3 rotates from the position of 0° to the position of 180° through the position of X1°, so that each of the compression chambers 45*a* to 45*f* is disconnected from the second communication passage 41. On the other hand, each of the pistons 7 moves from the top dead center to the bottom dead center while the drive shaft 3 rotates from the position of 180° to the position of 360°, so that each of the compression chambers 45*a* to 45*f* is connected to the second communication passage 41.

In FIGS. 7 and 8, the compression chamber 45*a* is in an early stage of a suction stroke in which the corresponding piston 7 moves from the top dead center to the bottom dead center. The compression chamber 45*b* is in a middle stage of a suction stroke. The compression chamber 45*c* is in a later stage of a suction stroke. The compression chambers 45*a* to 45*c* in a suction stroke communicate with the second communication passage 41 through the first communication passages 22*a* to 22*c*, respectively, so that the refrigerant gas is introduced into the compression chambers 45*a* to 45*c* by the suction mechanism 15.

On the other hand, the compression chamber 45*d* of the compression chambers 45*d* to 45*f* is in an early stage of a compression stroke in which the corresponding piston 7 moves from the bottom dead center to the top dead center. The compression chamber 45*e* is in a middle stage of a compression stroke. The compression chamber 45*f* is in a later stage of a compression stroke. Then, the compression chamber 45*f* is shifted from a compression stroke to a discharge stroke, so that the compressed refrigerant gas is discharged from the compression chamber 45*f* into the discharge chamber 29.

In the compressor, the first movable body 11 is disposed in the guiding window 3*d*, the forming surface 11*a* of the first movable body 11 faces, in the second shaft hole 23, some of the first communication passages 22*a* to 22*f* that are in communication with corresponding ones of the compression chambers 45*a* to 45*f* in a suction stroke. That is, the first communication passages 22*a* to 22*f* are connected to the second communication passage 41 by the first movable body 11, i.e. the movable body 10.

Meanwhile, the main body 3*e* of the second-diameter portion 3*c* is located opposite to the guiding window 3*d* with respect to the axis O. In the second shaft hole 23, the main body 3*e* faces some of the first communication passages 22*a* to 22*f* in communication with corresponding ones of the compression chambers 45*a* to 45*f* in a compression stroke or a discharge stroke. That is, the first communication passages 22*a* to 22*f* are disconnected from the second communication passage 41 by the main body 3*e*, i.e. the drive shaft 3.

That is, this compressor changes the flow rate of the refrigerant gas, which is discharged from the compression chambers 45*a* to 45*f* into the discharge chamber 29, per rotation of the drive shaft 3 by moving the first movable body 11 in the direction of the axis O in the guiding window 3*d*.

More specifically, in order to increase the flow rate of the refrigerant gas discharged from the compression chambers 45*a* to 45*f* into the discharge chamber 29, the control valve 13 increases its valve opening degree to increase the flow rate of the refrigerant gas introduced from the discharge chamber 29 into the control pressure chamber 27, thereby increasing the control pressure in the control pressure chamber 27. This increases the variable differential pressure, which is the differential pressure between the control pressure and the suction pressure.

The second movable body 12 of the movable body 10 begins to move forward in the direction of the axis O in the third axial passage 313 from a position at which the second movable body 12 is located in FIG. 6 due to the increasing variable differential pressure. The first movable body 11 begins to move forward in the direction of the axis O in the guiding window 3*d* against an urging force of the coil spring 37. Accordingly, the main-body passage 41*b* is displaced forward with respect to the first communication passages 22*a* to 22*f*, so that each of the first communication passages 22*a* to 22*f* is connected to the main-body passage 41*b* of the second communication passage 41 by the second movable body 12 in a region of the main-body passage 41*b* that is wider in the circumferential direction of the forming surface 11*a* than the other region of the main-body passage 41*b*. Accordingly, the compressor increases the communication angle gradually.

When the variable differential pressure is maximal, as illustrated in FIG. 5, the first movable body 11 of the movable body 10 is at its most forward position in the guiding window 3*d* and is in contact with the first limiting surface 301, so that each of the first communication passages 22*a* to 22*f* is connected to the main-body passage 41*b* in the second region 412 by the first movable body 11. Accordingly, the compressor maximizes the communication angle.

When the communication angle is maximal, as illustrated in FIG. 7, the main-body passage 41*b* communicates with the compression chamber 45*a* in an early stage of a suction stroke by rotation of the first movable body 11, and also communicates with the compression chambers 45*b*, 45*c* respectively in a middle stage and in a later stage of a suction stroke through the first communication passages 22*b*, 22*c*. In this state, the first communication passages 22*d* to 22*e* are disconnected from the main-body passage 41*b* by the main body 3*e* of the drive shaft 3. That is, when the communication angle is maximal, the refrigerant gas is introduced into each of the compression chambers 45*a* to 45*f* by the suction mechanism 15 through a suction stroke from an early stage to a later stage, so that the flow rate of the refrigerant gas introduced into the compression chambers 45*a* to 45*f* becomes maximal. Accordingly, the compressor maximizes the flow rate of the refrigerant gas discharged from the compression chambers 45*a* to 45*f* into the discharge chamber 29.

In contrast, to decrease the flow rate of the refrigerant gas discharged from the compression chambers 45*a* to 45*f* into the discharge chamber 29, the control valve 13 decreases its valve opening degree to decrease the flow rate of the refrigerant gas introduced from the discharge chamber 29 into the control pressure chamber 27, thereby decreasing the control pressure in the control pressure chamber 27. This decreases the variable differential pressure.

Accordingly, the first movable body 11 of the movable body 10 begins to move rearward in the guiding window 3*d* by an urging force of the coil spring 37 in the direction of the axis O, from a position at which the first movable body 11 is located in FIG. 5. Accordingly, the main-body passage 41*b* is displaced rearward with respect to the first communication passages 22*a* to 22*f*, so that each of the first communication passages 22*a* to 22*f* is connected to the main-body passage 41*b* by the first movable body 11 in a region of the main-body passage 41*b* that is narrower in the circumferential direction of the forming surface 11*a*. Accordingly, the compressor decreases the communication angle gradually, and the second movable body 12 begins to move rearward in the third axial passage 313 in the direction of the axis O along with the movement of the first movable body 11.

When the variable differential pressure is minimal, as illustrated in FIG. 6, the first movable body 11 is at its most rearward position in the guiding window 3*d* and is in contact with the second limiting surface 302, so that each of the first communication passages 22*a* to 22*f* is connected to the main-body passage 41*b* by the first movable body 11 in the first region 411. Accordingly, the compressor minimizes the communication angle.

When the communication angle is minimal, as illustrated in FIG. 8, only the first communication passage 22*a* is connected to the main-body passage 41*b* by rotation of the first movable body 11. That is, the main-body passage 41*b* communicates only with the compression chamber 45*a* that is in an early stage of a suction stroke. In this state, the forming surface 11*a* excluding the main-body passage 41*b* faces the first communication passage 22*b* in communication with the compression chamber 45*b* in a middle stage of a suction stroke and the first communication passage 22*c* in communication with the compression chamber 45*c* in a later stage of a suction stroke. Accordingly, the first communication passages 22*b*, 22*c* are disconnected from the main-body passage 41*b* by the forming surface 11*a* of the first movable body 11. Also, the first communication passages 22*d*, 22*e* are disconnected from the main-body passage 41*b* by the main body 3*e* of the drive shaft 3. That is, the minimum communication angle caused the refrigerant gas to be introduced into the compression chambers 45*a* to 45*f* by the suction mechanism 15 only when the compression chambers 45*a* to 45*f* are in an early stage of a suction stroke, so that the flow rate of the refrigerant gas introduced into each of the compression chambers 45*a* to 45*f* becomes minimal. Accordingly, the compressor minimizes the flow rate of the refrigerant gas discharged from the compression chambers 45*a* to 45*f* into the discharge chamber 29.

In the compressor, the refrigerant, which has been compressed in a compression stroke, partly flows toward the second shaft hole 23 through some of the first communication passages 22*a* to 22*f* in communication with corresponding ones of the compression chambers 45*a* to 45*f* in a compression stroke or in a discharge stroke. As described above, the main body 3*e* of the second-diameter portion 3*c* faces, in the second shaft hole 23, some of the first communication passages 22*a* to 22*f* in communication with corresponding ones of the compression chambers 45*a* to 45*f* in a compression stroke or a discharge stroke. In FIGS. 7 and 8, the compression chambers 45*d* to 45*f* are in a compression stroke. When the compression chamber 45*f* is turned into a discharge stroke by further rotation of the drive shaft 3, the main body 3*e* faces the first communication passages 22*e* to 22*f* in the second shaft hole 23 and thus receives a compressive load through the first communication passages 22*e* to 22*f*. On the other hand, the forming surface 11*a* of the first movable body 11 is located opposite to the main body 3*e* with respect to the axis O and does not face the first communication passages 22*a* to 22*f* in communication with the compression chambers 45*a* to 45*f* in a compression stroke. The second movable body 12 is located in the second-diameter portion 3*c*. Accordingly, the compressive load hardly acts on the movable body 10. Since the drive shaft 3 is made of steel, the main body 3*e*, i.e. the second-diameter portion 3*c* appropriately supports the movable body 10 even when the main body 3*e*, i.e. the second-diameter portion 3*c* is pressed in a direction intersecting with the direction of the axis O by an acting compressive load.

This configuration of the compressor facilitates the movement of the first movable body 11 in the direction of the axis O in the guiding window 3*d*. Accordingly, the compressor appropriately changes the flow rate of the refrigerant gas discharged from the compression chambers 45*a* to 45*f* into the discharge chamber 29 per rotation of the drive shaft 3. This compressor does not need to increase a size of the movable body 10 to obtain greater thrust.

Therefore, this compressor according to the embodiment can be reduced in size while exhibiting high controllability.

It is noted that, in this compressor, the first movable body 11 is disposed in the guiding window 3*d*, and the forming surface 11*a* and the second communication passage 41 are exposed in the second shaft hole 23. Accordingly, in the second shaft hole 23, the forming surface 11*a* and the second communication passage 41 face some of the first communication passages 22*a* to 22*f* in communication with corresponding ones of the compression chambers 45*a* to 45*f* in a suction stroke. The first movable body 11 receives a centrifugal force generated by rotation of the drive shaft 3 and moves outward in a radial direction of the second-diameter portion 3*c* in the second shaft hole 23. This decreases a gap between the forming surface 11*a* and the first communication passages 22*a* to 22*f* in the second shaft hole 23, thereby reducing leak of the refrigerant gas while the refrigerant gas is supplied from the second communication passage 41 to the first communication passages 22*a* to 22*f*, and thus, this enables the refrigerant gas to be appropriately introduced into the compression chambers 45*a* to 45*f* in a suction stroke.

Further, in this compressor, the first movable body 11 is disposed in the guiding window 3*d*, and the forming surface 11*a* with the main body 3*e* fits to the second shaft hole 23. This configuration enables the second-diameter portion 3*c* and the first movable body 11 to rotate appropriately in the second shaft hole 23.

Further, this compressor performs an inlet-side control such that the control valve 13 changes a flow rate of the refrigerant gas introduced from the discharge chamber 29 into the control pressure chamber 27 through the first supply passage 13*b* and the second supply passage 13*c*. This enables a pressure in the control pressure chamber 27 to become higher quickly, thereby increasing the flow rate of the refrigerant gas discharged from each of the compression chambers 45*a* to 45*f* into the discharge chamber 29 quickly.

Although the present disclosure has been described by the above embodiment, the present disclosure is not limited to the above embodiment, and may be modified within the scope of the present disclosure.

For example, the compressor according to the embodiment may be a double-head piston compressor.

In the first movable body 11, a part of the forming surface 11*a* or whole of the forming surface 11*a* may face the first communication passages 22*a* to 22*f* in communication with the compression chambers 45*a* to 45*f* in a discharge stroke. In this configuration, the first movable body 11 does not receive whole compressive load, and the first movable body 11 moves in the direction of the axis O without being prevented.

The compressor may be configured to increase the flow rate of the refrigerant gas, which is discharged from the compression chambers 45*a* to 45*f* into the discharge chamber 29 by backward movement of the first movable body 11 in the direction of the axis O in the guiding window 3*d*.

The compressor may be configured such that the suction mechanism 15 introduces the refrigerant gas into only a compression chamber of the compression chambers 45*a* to 45*f* that is in a later stage of a suction stroke when the communication angle is minimal.

The flow rate of the refrigerant gas, which is discharged from the compression chambers 45*a* to 45*f* into the discharge chamber 29 per rotation of the drive shaft 3, may be increased by an increase of the communication angle and decreased by a decrease of the communication angle.

In the compressor according to the embodiment, the swash plate chamber 31 also serves as a suction chamber. However, a suction chamber may be formed in the housing 1 separately from the swash plate chamber 31.

In the compressor according to the embodiment, the control pressure chamber 27 is formed in the rear housing 19. However, the control pressure chamber 27 may be formed in each of the rear housing 19 and the cylinder block 21. The control pressure chamber 27 may be formed in the drive shaft 3.

The compressor may include, instead of the shoes 8*a*, 8*b*, a wobble conversion mechanism that includes a wobble plate supported on a rear surface of the fixed swash plate 5 via a thrust bearing and connected to the pistons 7 via respective connecting rods.

The compressor according to the embodiment, the communication angle changes according to a position of the first movable body 11 in the guiding window 3*d*, i.e., a position of the movable body 10 in the direction of the axis O, so that the flow rate of the refrigerant gas discharged from each of the compression chambers 45*a* to 45*f* into the discharge chamber 29 changes. However, the compressor may be configured such that the flow rate of the refrigerant gas discharged from each of the compression chambers 45*a* to 45*f* into the discharge chamber 29 changes by a change of a communication area between the first communication passages 22*a* to 22*f* and the second communication passage 41 according to a position of the movable body 10 in the direction of the axis O.

In the compressor according to the embodiment, the control pressure may be controlled externally by on-off control of external current to the control valve 13, or the control pressure may be controlled internally without using external current. For the external control of the control pressure, the compressor may be configured such that the opening degree of the control valve 13 is decreased by shut-off of the control valve 13 from the current. This configuration allows the opening degree of the control valve 13 to decrease and the control pressure in the control pressure chamber 27 to decrease during the stop of the compressor, thereby allowing the compressor to start in a state in which the flow rate of the refrigerant gas discharged from each of the compression chambers 45*a* to 45*f* into the discharge chamber 29 is minimum, and reducing a shock caused by starting the compressor.

The compressor according to the embodiment may perform an outlet-side control such that the control valve 13 changes a flow rate of the refrigerant gas introduced from the control pressure chamber 27 into the swash plate chamber 31 through the bleed passage. This enables the amount of the refrigerant gas in the discharge chamber 29, which is used for changing the flow rate of the refrigerant discharged from each of the compression chambers 45*a* to 45*f* into the discharge chamber 29, to be decreased, and thus increases the efficiency of the compressor. In this case, the compressor may be configured such that the opening degree of the control valve 13 is increased by shut-off of the control valve 13 from the current. This configuration allows the opening degree of the control valve 13 to increase and the control pressure in the control pressure chamber 27 to decrease during the stop of the compressor, thereby allowing the compressor to start in the state in which the flow rate of the refrigerant gas discharged from each of the compression chambers 45*a* to 45*f* into the discharge chamber 29 is minimum, and reducing a shock caused by starting the compressor.

The compressor according to the embodiment may include a three-way valve that adjusts the opening degrees of bleeding and supply passages, instead of the control valve 13.

The present disclosure is applicable to an air conditioning device for a vehicle.

What is claimed is:

1. A piston compressor comprising:

a housing including a cylinder block, a discharge chamber, a swash plate chamber, and a shaft hole, the cylinder block having a plurality of cylinder bores and a plurality of first communication passages in communication with the plurality of cylinder bores;

a drive shaft rotatably supported in the shaft hole;

a fixed swash plate configured to rotate in the swash plate chamber by rotation of the drive shaft and having a constant inclination angle with respect to a plane that is perpendicular to the drive shaft;

a plurality of pistons, each of the pistons being accommodated in the corresponding cylinder bore, the piston forming a compression chamber in the cylinder bore and being coupled to the fixed swash plate;

a discharge valve configured to discharge refrigerant from the compression chamber into the discharge chamber;

a movable body disposed in the drive shaft and rotatable together with the drive shaft, the movable body being movable with respect to the drive shaft in a direction of an axis of the drive shaft according to a control pressure, the movable body having a second communication passage that intermittently communicates with each of the first communication passages by the rotation of the drive shaft, wherein a flow rate of the refrigerant discharged from the compression chamber into the discharge chamber changes according to a position of the movable body in the direction of the axis of the drive shaft; and a control valve configured to control the control pressure, wherein the first communication passages are connected to the second communication passage by the movable body, and some of the first communication passages are disconnected from the second communication passage by the outer surface of the drive shaft that is exposed to the some of the first communication passages.

2. The piston compressor according to claim 1, wherein the drive shaft includes a main body and a guiding window, the main body faces the some of the first communication passages in communication with the corresponding compression chamber in a compression stroke or a discharge stroke, and the guiding window is located opposite to the main body with respect to the axis, and the guiding window exposes the movable body to the shaft hole while guiding the movable body, and the movable body is disposed in the guiding window and is movable in the direction of the axis of the drive shaft.

3. The piston compressor according to claim 2, wherein the movable body includes a forming surface and the second communication passage, the forming surface with the main body fits to the shaft hole, and the second communication passage is recessed in the forming surface.

4. The piston compressor according to claim 1, wherein the second communication passage is formed in an outer peripheral surface of the movable body.

5. The piston compressor according to claim 1, wherein a communication angle around the axis that is formed by the second communication passage and the first communication passages communicating with the second communication passage per rotation of the drive shaft changes according to the position of the movable body in the direction of the axis.

6. A piston compressor comprising:

a housing including a cylinder block, a discharge chamber, a swash plate chamber, and a shaft hole, the cylinder block having a plurality of cylinder bores and a plurality of first communication passages in communication with the plurality of cylinder bores;

a drive shaft rotatably supported in the shaft hole;

a fixed swash plate configured to rotate in the swash plate chamber by rotation of the drive shaft and having a constant inclination angle with respect to a plane that is perpendicular to the drive shaft;

a plurality of pistons, each of the pistons being accommodated in the corresponding cylinder bore, the piston forming a compression chamber in the cylinder bore and being coupled to the fixed swash plate;

a discharge valve configured to discharge refrigerant from the compression chamber into the discharge chamber;

a movable body disposed in the drive shaft and rotatable together with the drive shaft, the movable body being movable with respect to the drive shaft in a direction of an axis of the drive shaft according to a control pressure, the movable body having a second communication passage that intermittently communicates with each of the first communication passages by the rotation of the drive shaft, wherein a flow rate of the refrigerant discharged from the compression chamber into the discharge chamber changes according to a position of the movable body in the direction of the axis of the drive shaft; and a control valve configured to control the control pressure, wherein the drive shaft includes a main body that faces some of the first communication passages in communication with the corresponding compression chamber in a compression stroke or a discharge stroke, the movable body has a forming surface that is located opposite to the main body with respect to the axis and is exposed in the shaft hole, the first communication passages are connected to the second communication passage by the movable body, and the some of the first communication passages are disconnected from the second communication passage by the main body facing the some of the first communication passages.

7. The piston compressor according to claim 6, wherein the forming surface forms a cylindrical body by cooperating with the main body.

8. The piston compressor according to claim 6, wherein the compression chamber is in a suction stroke while the piston moves from a top dead center to a bottom dead center, the compression chamber is in the compression stroke or the discharge stroke while the piston moves from the bottom dead center to the top dead center, the some of the first communication passages are disconnected from the second communication passage by the main body facing the some of the first communication passages that are in communication with the corresponding compression chamber in the compression stroke or the discharge stroke, and at least one of the first communication passages is disconnected from the second communication passage by the forming surface that faces the at least one first communication passage in communication with the corresponding compression chamber in the suction stroke as the movable body moves such that the flow rate of the refrigerant gas introduced into the compression chamber in the suction stroke is reduced.

9. The piston compressor according to claim 6, wherein the drive shaft includes a guiding window that is located opposite to the main body with respect to the axis, and the guiding window exposes the movable body to the shaft hole while guiding the movable body, the movable body is disposed in the guiding window and is movable in the direction of the axis of the drive shaft, the drive shaft has a limiting surface that comes into contact with the movable body to limit a movement of the movable body in the direction of the axis, and the limiting surface is formed in the guiding window.

10. The piston compressor according to claim 6, wherein the drive shaft includes a guiding window that is located opposite to the main body with respect to the axis, and the guiding window exposes the movable body to the shaft hole while guiding the movable body, the movable body is disposed in the guiding window and is movable in the direction of the axis of the drive shaft, the main body has a guiding surface that faces the guiding window and extends in the direction of the axis, and the movable body has a guided surface that is guided by the guiding surface.

11. The piston compressor according to claim 6, wherein the second communication passage is formed in an outer peripheral surface of the movable body.

12. The piston compressor according to claim 6, wherein a communication angle around the axis that is formed by the second communication passage and the first communication passages communicating with the second communication per rotation of the drive shaft changes according to the position of the movable body in the direction of the axis.

* * * * *